United States Patent [19]

Logan

[11] Patent Number: 5,055,010

[45] Date of Patent: Oct. 8, 1991

[54] SUCTION BAFFLE FOR REFRIGERATION COMPRESSOR

[75] Inventor: Kent E. Logan, Englewood, Ohio

[73] Assignee: Copeland Corporation, Sidney, Ohio

[21] Appl. No.: 591,441

[22] Filed: Oct. 1, 1990

[51] Int. Cl.[5] ..... F04B 17/00; F04B 21/00; F03C 2/00; B01D 45/00

[52] U.S. Cl. ..... 417/410; 417/312; 417/902; 418/55.6; 418/DIG. 1; 55/462; 55/437

[58] Field of Search ..... 417/410, 360, 312, 902; 418/55.6, DIG. 1; 55/462, 437

[56] References Cited

U.S. PATENT DOCUMENTS 4,560,329 12/1985 Hirahara et al. ..... 417/902

4,586,875 5/1986 Aman, Jr. ..... 417/902

4,696,629 9/1987 Shiibayashi et al. .

4,767,293 8/1988 Caillat et al. .

4,936,756 6/1990 Shimizu et al. ..... 418/55.6

*Primary Examiner*—Richard A. Bertsch

*Assistant Examiner*—Alfred Basichas

*Attorney, Agent, or Firm*—Harness, Dickey & Pierce

[57] ABSTRACT

A hermetic refrigeration compressor is disclosed which includes a baffle member secured to the inner surface of the outer shell in overlying relationship to a suction inlet port. The suction baffle includes a dome shaped portion centrally disposed with respect to the inlet port and provides axially upper and lower openings defined between the baffle member and the inner surface of the outer shell.

12 Claims, 2 Drawing Sheets

SUCTION BAFFLE FOR REFRIGERATION COMPRESSOR

BACKGROUND AND SUMMARY OF THE INVENTION

The present invention relates generally to refrigeration compressors and more specifically to hermetic refrigeration compressors which incorporates a baffle in overlying relationship to the suction inlet port provided in the outer shell.

Hermetic refrigeration compressors generally have a suction inlet port provided in the sidewall of the outer shell for admitting suction gas into the interior of the shell. Because the suction gas being returned to the compressor may often contain lubricant and/or liquid refrigerant which could cause slugging of the compressor, it has been common practice to locate the inlet port in spaced relationship to the compressor suction inlet opening and/or to incorporate baffles in overlying relationship to such inlet ports to thereby reduce the possibility of such liquid being ingested into the compressor. However, the use of such baffles may create a restriction on the flow of refrigerant into the hermetic shell thereby resulting in higher back pressure on the system.

The present invention provides a hermetic refrigeration compressor which incorporates a unique baffle member positioned in overlying relationship to the suction inlet port. The unique baffle member includes a generously sized dome having the concave surface portion thereof centrally located in overlying facing relationship to the suction inlet port and axially spaced upper and lower openings defined between the baffle and shell. The dome shaped portion serves to minimize the pressure drop resulting from the change in fluid flow direction from generally horizontal to vertical within the shell thereby reducing the possible back pressure on the system. The opposite lateral edges of the baffle member are secured to the outer shell thus serving to direct the fluid flow either axially upwardly to the compressor inlet opening or downwardly to aid in cooling of the driving motor. Additionally, the baffle member serves to restrict the reflection of noise generating vibration occurring within the compressor from being reflected outwardly through the suction inlet port.

Additional advantages and features of the present invention will become apparent from the subsequent description and the appended claims taken in conjunction with the accompanying drawings.

DESCRIPTION OF THE PREFERRED EMBODIMENT

Figure 1:
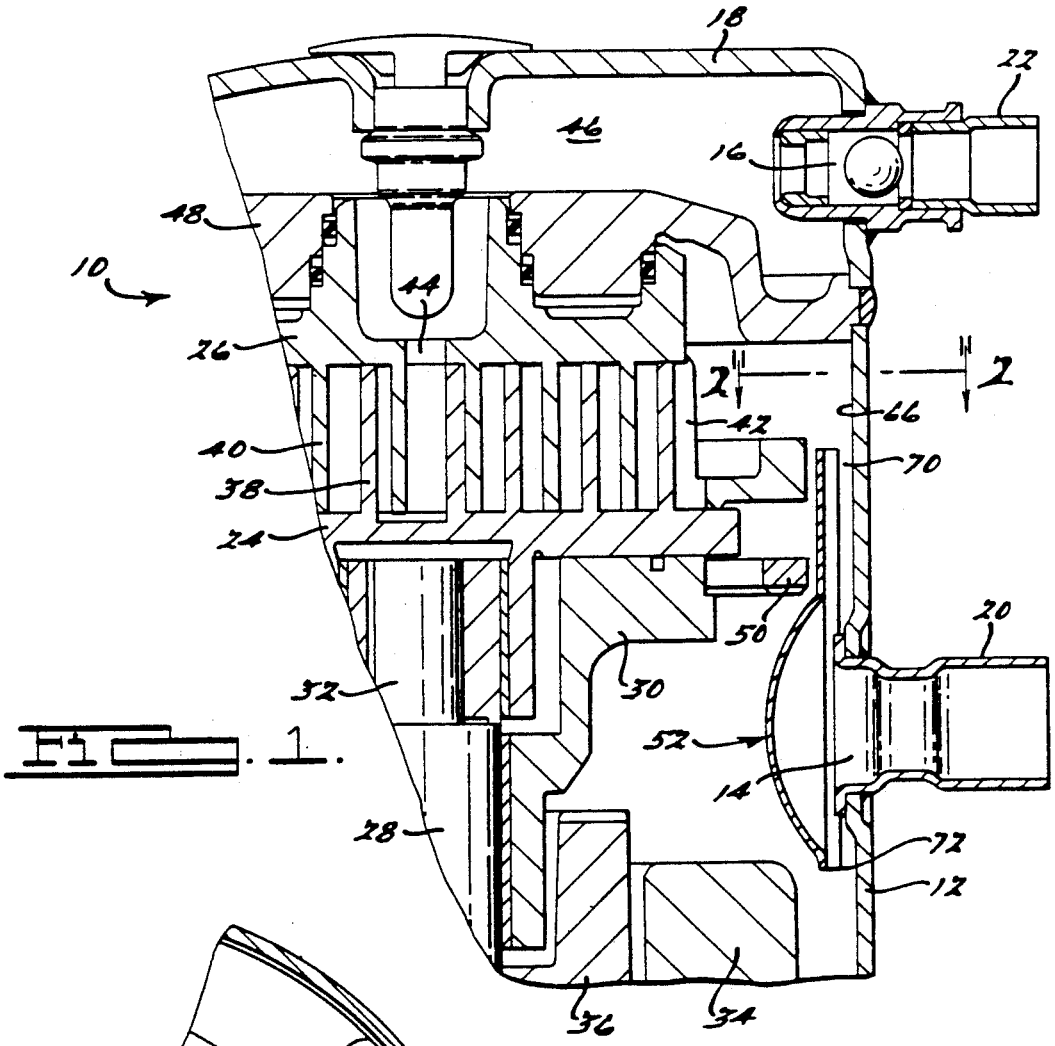
FIG. 1 is a fragmentary section view of a refrigeration compressor incorporating a unique suction baffle in accordance with the present invention.
Figure 2:
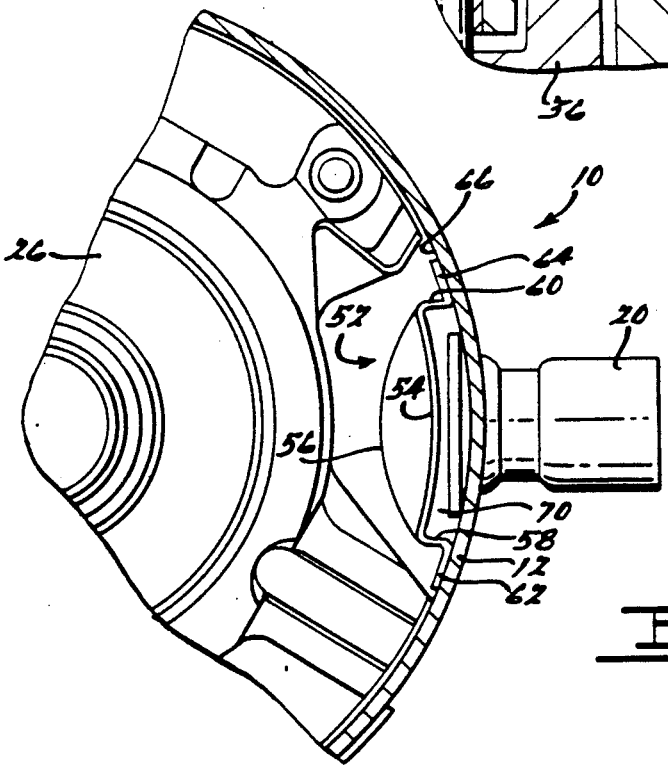
FIG. 2 is also a fragmentary section view of the compressor of FIG. 1, the section being taken along line 2—2 thereof.

Referring now to the drawings and in particular to FIGS. 1 and 2, there is shown a hermetic refrigeration compressor 10 of the scroll type. Compressor 10 includes an outer hermetically sealed shell 12 which includes a suction inlet port 14 provided in a sidewall portion thereof and a discharge port 16 provided in a cover member 18 secured to the upper end of shell 12. Suitable inlet and discharge fittings 20 and 22 are secured to respective ports 14 and 16 for connecting the compressor to a refrigeration system.

A scroll-type compressor is disposed within shell 12 and includes orbiting and non-orbiting scroll members 24 and 26, a drive shaft 28 rotatably supported by a bearing housing 30, the drive shaft having an eccentric pin 32 at the upper end thereof coupled to orbiting scroll member 24 which operates to orbitally drive same. A driving motor is disposed in a lower portion of shell 12 and includes a stator 34 supported by shell 12 and a rotor 36 carried by drive shaft 28.

Scroll members 24 and 26 include interleaved spiral wraps 38 and 40 which operate to define moving fluid pockets of changing volume as scroll member 24 orbits with respect to scroll member 26. A compressor suction inlet opening 42 is provided in non-orbiting scroll member 26 for admitting suction gas into the compressor and a central discharge passage 44 is provided which communicates with a discharge muffler chamber 46 defined between top 18 and partition member 48. An Oldham coupling 50 is also provided which operates to prevent relative rotation between scroll members 24 and 26. Scroll-type compressor 10 may be of the type more fully disclosed in assignee's U.S. Pat. No. 4,767,293, the disclosure of which is hereby incorporated by reference. Additionally, scroll compressor may also incorporate one or more of the modifications disclosed in assignee's copending applications Ser. No. 591,444 entitled "Non-Orbiting Scroll Mounting Arrangements For A Scroll Machine" filed of even date herewith; Ser. No. 591,443 entitled "Oldham Coupling For Scroll Compressor" filed of even date herewith; Ser. No. 591,454 entitled "Scroll Machine With Floating Seal" filed of even date herewith; and Ser. No. 591,442 entitled "Counterweight Shield For Refrigeration Compressor" filed of even date herewith, the disclosures of which are all incorporated by reference.

Figure 3:
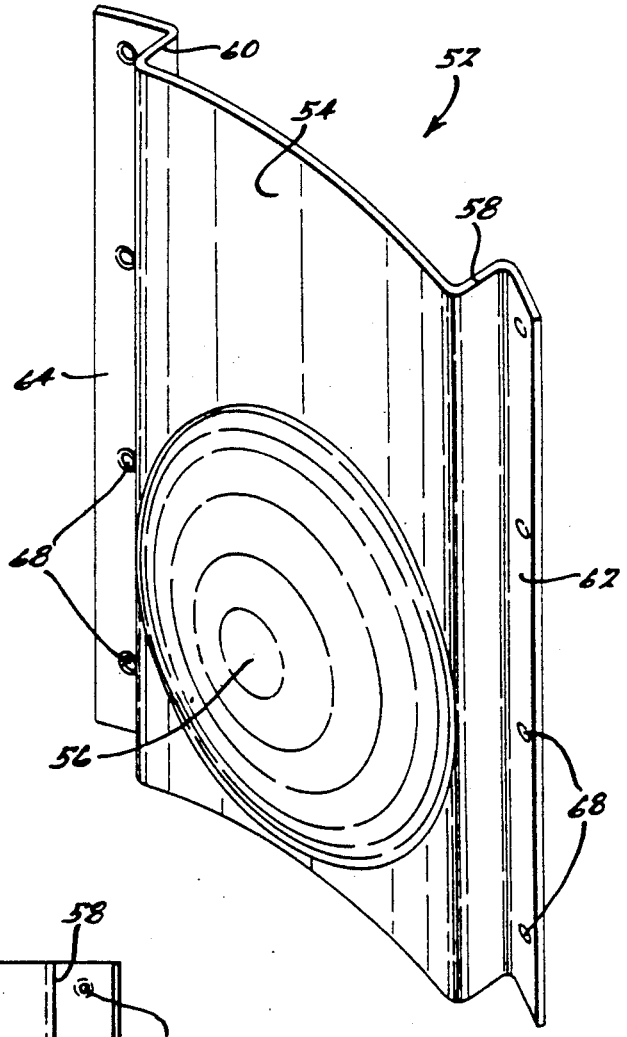
FIG. 3 is a perspective view of the suction baffle incorporated in the refrigeration compressor of FIG. 1.
Figure 4:
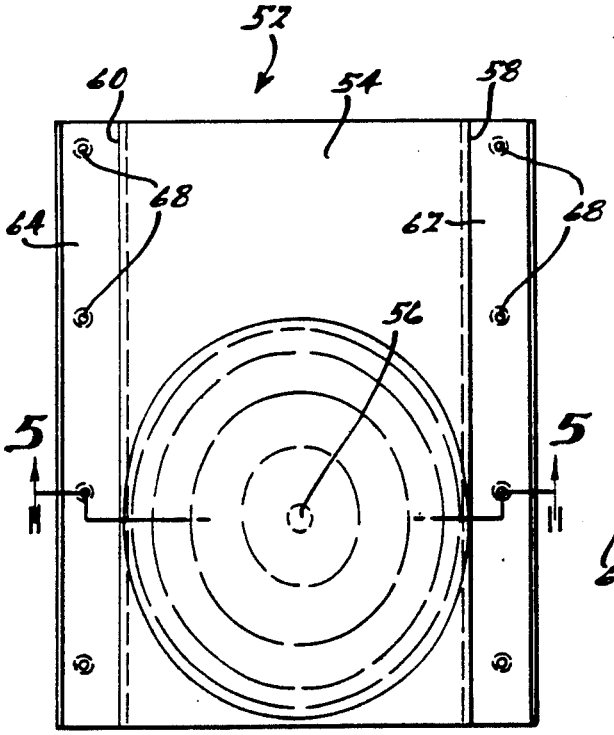
FIG. 4 is an elevational view of the suction baffle of FIG. 3.
Figure 5:
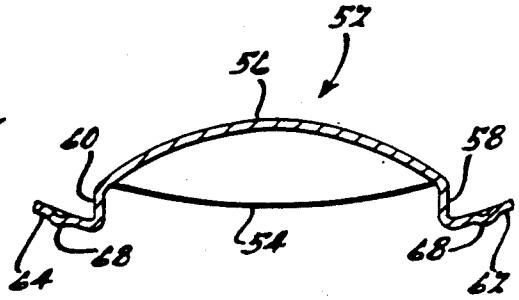
FIG. 5 is a section view of the suction baffle of FIG. 4, the section being taken along line 5—5 thereof.

A suction baffle 52 is also provided being secured to shell 12 in overlying relationship to suction inlet port 14. As best seen with reference to FIGS. 3 through 5, suction baffle 52 includes an arcuately shaped axially elongated mid or central portion 54 having a dome shaped depression 56 formed therein adjacent one end thereof. In order to position midportion 52 in spaced relationship to shell 12, a pair of generally parallel standoff flange portions 58 and 60 are formed extending along the opposite lateral edges of midportion 54. A pair of axially elongated attachment flanges 62 and 64 are formed along the opposite outer lateral edges of flange portions 58 and 60 and serve to abut the inner surface 66 of shell 12.

Preferably, baffle 52 will be secured to surface 66 of shell 12 by spot welding. In order to facilitate this attachment, each of the attachment flanges 62 and 64 are provided with a plurality of axially spaced protrusions 68 along the length thereof. Protrusion 68 serve to provide a series of point contacts with surface 66 of shell 12 which operate to concentrate the electrical energy supplied during the spot welding operation thereby aiding in assuring a secure attachment of baffle 52.

As best seen with reference to FIGS. 1 and 2, baffle 52 is secured to surface 66 of shell 12 with dome portion 56 substantially centered vertically and circumferentially on inlet port 14 with the concave side thereof in facing relationship therewith. Additionally, as shown therein, the radius of curvature of midportion 54 is such that midportion 54 follows or conforms to the curvature of shell 12. Similarly, flange portions 62 and 64 may be bowed or curved in a lateral direction so as to thereby provide a close fit with surface 66 of shell 12 along the entire axial length thereof so as to thereby assure suction gas and oil entering suction inlet port 14 will be directed in an axial or vertical direction. It should also be noted that midportion 54 will preferably have a width substantially greater than the diameter of inlet port 14 and dome portion will likewise have a diameter greater than the diameter of port 14. Further, the width of standoff flange portions 58 and 60 will be selected so as to avoid interference with positioning of the compressor components while maximizing the size of axially upper and lower openings 70 and 72 defined between baffle 52 and surface 66 of shell 12. Also, the axial length of baffle 52 will preferably be such as to position upper opening 70 in relatively closely spaced relationship to compressor inlet opening 42.

In operation, as suction gas which may have lubricant and/or liquid refrigerant entrained therein enters compressor 10 through port 14, the heavier liquid droplets will impinge on dome portion 56, collect there, and thereafter flow downwardly through lower opening 72. The suction gas will also impinge upon dome area and will flow upwardly between baffle 52 and shell 12 exiting through opening 70 whereupon it will be drawn into the compression chambers through inlet 42. A portion of this suction gas may also flow downwardly through opening 72 and circulate about stator 34 and rotor 36 thereby serving to cool same. The presence of dome 52 positioned in overlying relationship to inlet port 14 serves to aid in transforming the entering horizontal fluid flow to a vertically directed flow and provides a chamber of sufficient volume in this area to reduce the pressure drop associated with this flow direction change which in turn will avoid subjecting the upstream refrigeration system to excessive back pressures. Further, the presence of baffle 52 serves to minimize the reflection of compressor noise or vibration outwardly through the suction inlet tube. In addition to the above, baffle 52 also serves to prevent suction gas and more importantly any liquid refrigerant which may be entrained therein from directly impinging on bearing housing 30. The shape of baffle 52 also lends itself to very economical fabrication from sheet metal stock as well as easy securement to the shell thereby minimizing the costs associated with providing same. Thus, as may now be appreciated, the baffle of the present invention provides an economical means for efficiently redirecting suction gas flow entering the compressor as well as aiding in separation of liquid entrained therein and reduction of reflected noise. It should be noted that while baffle 52 has been disclosed in connection with a scroll-type compressor, it may also be employed in other types of compressors such as reciprocating piston types for example.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A hermetic fluid compressor comprising:

a hermetic shell having a fluid inlet port opening through a sidewall thereof;

a motor compressor disposed within said shell and having a fluid inlet spaced from said inlet port;

a baffle member affixed to said shell and including a dome shaped portion centrally disposed with respect to the axis of said inlet port and means defining openings communicating with the interior of said shell above and below said dome shaped portion.

2. A hermetic fluid compressor as claimed in claim 1 wherein said baffle includes an axially elongated midportion positioned in spaced relationship to said shell, and laterally spaced edge portions secured to said shell.

3. A hermetic fluid compressor as claimed in claim 2 wherein said midportion is arcuately shaped.

4. A hermetic fluid compressor as claimed in claim 2 wherein said laterally spaced edge portions are secured to said shell by welding.

5. A hermetic fluid compressor as claimed in claim 4 further including a plurality of axially spaced protrusions formed along each of said laterally spaced edge portions, said protrusions being operative to facilitate welding of said lateral edge portions to said shell.

6. A hermetic fluid compressor as claimed in claim 2 wherein said midportion extends axially upwardly a distance sufficient to position said upper opening adjacent said compressor inlet opening.

7. A hermetic fluid compressor as claimed in claim 1 wherein said upper and lower openings are defined between said baffle and said shell.

8. A hermetic fluid compressor as claimed in claim 1 wherein said upper and lower openings are oriented in an axial direction whereby said baffle operates to reduce transmission of noise vibrations outwardly of said shell through said inlet port.

9. A hermetic refrigeration compressor comprising:

an outer shell having an inlet port opening through a sidewall thereof;

compressor means disposed within said shell adjacent one end thereof, said compressor means including a suction gas inlet spaced from said inlet port for drawing suction gas from the interior of said shell into said compressor means;

motor means disposed within said shell, said motor means being operatively connected to said compressor means for driving same; and baffle means, said baffle means including an axially elongated midportion having a dome shaped portion formed thereon intermediate the ends thereof, attachment flange portions extending along opposite lateral edges of said midportion, said attachment flange portions being secured to said outer shell with said dome shaped portion being generally centered in overlying relationship to said inlet port and said midportion being supported in spaced relationship to said shell so as to define an axially extending passageway therebetween opening into the interior of said shell above and below said dome shaped portion.

10. A hermetic refrigeration compressor as claimed in claim 9 wherein the axial length of said midportion is sufficient so as to place one of said upper and lower openings adjacent said suction gas inlet.

11. A hermetic refrigeration compressor as claimed in claim 9 wherein said midportion is laterally bowed so as to generally follow the curvature of said outer shell.

12. A hermetic refrigeration compressor as claimed in claim 9 wherein said baffle is formed from sheet metal.

* * * * *